US009545730B2

(12) United States Patent
Sablatschan

(10) Patent No.: US 9,545,730 B2
(45) Date of Patent: Jan. 17, 2017

(54) HAIR CLIPPING DEVICE

(71) Applicant: KONINKLIJKE PHILIPS N.V., Eindhoven (NL)

(72) Inventor: Siegfried Sablatschan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/418,518

(22) PCT Filed: Jun. 28, 2013

(86) PCT No.: PCT/EP2013/063735

§ 371 (c)(1),
(2) Date: Jan. 30, 2015

(87) PCT Pub. No.: WO2014/019782

PCT Pub. Date: Feb. 6, 2014

(65) Prior Publication Data

US 2015/0209969 A1 Jul. 30, 2015

(30) Foreign Application Priority Data

Jul. 31, 2012 (EP) ..... 12178596

(51) Int. Cl.
*B26B 19/28* (2006.01)
*B26B 19/06* (2006.01)
(Continued)

(52) U.S. Cl.
CPC ..... *B26B 19/28* (2013.01); *B26B 19/06* (2013.01); *B26B 19/12* (2013.01); *B26B 19/3846* (2013.01)

(58) Field of Classification Search
CPC ..... B26B 19/00–19/48
(Continued)

(56) References Cited

U.S. PATENT DOCUMENTS 1,939,253 A * 12/1933 Dremel ..... B26B 19/22 30/195
3,589,007 A 6/1971 Walton
(Continued)

FOREIGN PATENT DOCUMENTS

DE 1159810 B 12/1963
DE 10302998 A1 8/2004
(Continued)

*Primary Examiner* — Jason Daniel Prone
*Assistant Examiner* — Richard Crosby, Jr.

(57) ABSTRACT

The present invention relates to a hair clipping device, comprising: a housing; a cutting assembly (12) which is arranged on one end of said housing and comprises a stationary blade (14) and a moveable blade (16) that is resiliently biased against the stationary blade (14), wherein the stationary blade (14) and the moveable blade (16) define a cutting plane (30) between each other, wherein the stationary blade (14) comprises a first recess (34) and the moveable blade (16) comprises a second recess (32), wherein the first and the second recess (34, 32) are arranged on top of each other; a motor (18) for driving an eccentric transmission element (26); and a coupling element (28) coupled to said eccentric transmission element (26) for translating a movement of said eccentric transmission element (26) into an oscillatory movement of the moveable blade (16) relative to the stationary blade (14); wherein said eccentric transmission element (26) engages the coupling element (28) at at least one engagement point (38'), wherein said at least one engagement point (38) is in at least one operating position during the movement of said eccentric transmission element (26) within said cutting plane (30), and wherein the coupling element (28) is arranged in said first and second recess (34, 32).

11 Claims, 8 Drawing Sheets

(51) Int. Cl.
*B26B 19/38* (2006.01)
*B26B 19/12* (2006.01)

(58) Field of Classification Search
USPC ..... 30/208–210, 215–220
See application file for complete search history.

(56) References Cited

U.S. PATENT DOCUMENTS

| | | | | |
|---|---|---|---|---|
| 3,646,675 | A * | 3/1972 | Wezel | 30/217 |
| 4,214,365 | A * | 7/1980 | Walter et al. | 30/224 |
| 4,221,050 | A * | 9/1980 | Walter | B26B 19/20 30/216 |
| 7,350,314 | B2 * | 4/2008 | McCambridge | B26B 15/02 33/626 |
| 8,453,333 | B2 * | 6/2013 | Long | B26B 19/06 30/210 |
| 8,769,824 | B2 * | 7/2014 | Heerlein et al. | 30/43.92 |
| 8,806,757 | B2 * | 8/2014 | Moseman | B26B 19/205 30/208 |
| 8,844,142 | B2 * | 9/2014 | Kammer | 30/201 |
| 9,038,276 | B2 * | 5/2015 | Arndt et al. | 30/208 |
| 2004/0083865 | A1 * | 5/2004 | Stevens | 83/13 |
| 2005/0011076 | A1 * | 1/2005 | Andis | B26B 19/06 30/223 |
| 2006/0042096 | A1 * | 3/2006 | Liao | B26B 19/06 30/223 |
| 2006/0064878 | A1 * | 3/2006 | Melton | B26B 19/28 30/216 |
| 2008/0040927 | A1 * | 2/2008 | Lau | B26B 19/14 30/34.1 |
| 2009/0000125 | A1 | 1/2009 | Peyser | |
| 2011/0119930 | A1 * | 5/2011 | Scheunert | 30/228 |
| 2011/0265331 | A1 * | 11/2011 | Moseman | 30/43.92 |
| 2012/0084983 | A1 | 4/2012 | Moseman | |
| 2015/0209969 | A1 | 7/2015 | Sablatschan | |

FOREIGN PATENT DOCUMENTS

| | | | |
|---|---|---|---|
| EP | 0278759 | A1 | 8/1988 |
| GB | 900522 | A | 2/1959 |
| GB | 1091081 | B | 8/1964 |
| GB | 2318079 | A | 4/1998 |
| JP | 5498857 | A | 8/1979 |
| JP | 5964087 | A | 4/1984 |
| KR | 201007504 | U | 7/2010 |
| WO | 9838016 | A1 | 9/1998 |
| WO | 2009081301 | A1 | 7/2009 |
| WO | 2009084983 | A1 | 7/2009 |
| WO | 2010121941 | A2 | 10/2010 |
| WO | 2011069673 | A1 | 6/2011 |

* cited by examiner

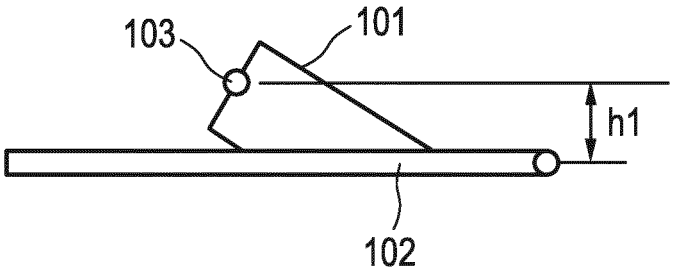
(PRIOR ART) FIG. 1A
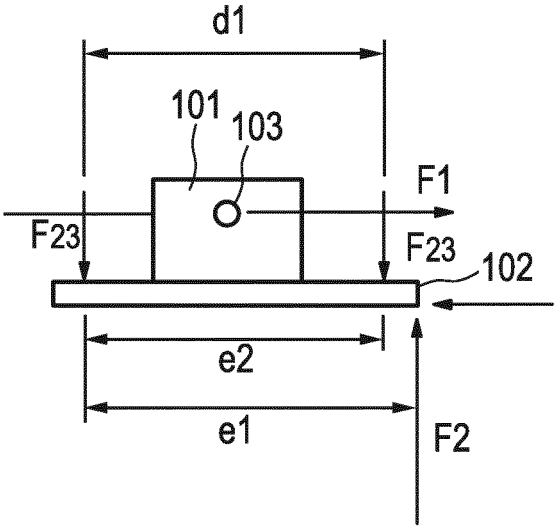
(PRIOR ART) FIG. 1B

HAIR CLIPPING DEVICE

This application is the U.S. National Phase application under 35 U.S.C. §371 of International Application No. PCT/EP2013/063735, filed on Jun. 28, 2013, which claims the benefit of International Application No. 12178596.8 filed on Jul. 31, 2012. These applications are hereby incorporated by reference herein.

FIELD OF THE INVENTION

The present invention relates to a hair clipping device. Further, the present invention relates to a cutting assembly for use in such a hair clipping device.

BACKGROUND OF THE INVENTION

Electric hair cutting appliances are generally known and include trimmers, clippers and shavers whether powered by main supplied electricity or batteries. Such devices are generally used to trim body hair, in particular facial and head hair to allow a person to have a well-groomed appearance. These devices can, of course, also be used to trim pet hair or any other type of hair.

Conventional hair cutting devices comprise a main body forming an elongated housing having a front or cutting end and an opposite handle end. A cutting blade assembly is disposed at the cutting end. The cutting blade assembly usually comprises a stationary blade element and a movable blade element which moves in a reciprocal, translatory manner relative to the stationary blade element. The cutting blade assembly itself extends from the cutting end and is usually fixed in a single position relative to the main body of the hair clipper, such that the orientation of the cutting blade assembly is determined by a user orientating the main body of the device.

In common cutting units, the cutting force driving the movable blade is usually transmitted through an electric motor driven eccentric. This eccentric is driven by an electric motor in a rotary manner. The rotary movement of the eccentric is then translated via a so-called driving bridge, which is connected to the movable blade, into the resulting reciprocal, translatory movement of the movable blade.

The attached FIG. 1 schematically illustrates an exemplary arrangement of such a driving bridge 101 on the movable blade 102 as it is commonly realized according to the prior art. As it can be seen from FIG. 1A, the driving bridge 101 is usually mounted or fixed on the upper surface of the movable blade 102. The electric motor driven eccentric usually engages the driving bridge 101 at an engagement point 103, which engagement point 103 is located above the movable cutting blade 102 and has a predetermined distance (indicated as distance h1) from the movable cutting blade 102. The eccentric thus usually has a big distance from the level where the cutting forces from the teeth are working (referred to as cutting level or cutting plane) to the engagement where the electric motor driven eccentric engages the driving bridge. Said distance from the engagement of the electric motor driven eccentric to the cutting level in many known prior art hair clipping devices results in a so-called pulling effect. The pulling effect is an unwanted lifting of the movable cutting blade from the stationary cutting blade, which may especially occur during heavy load hair cutting. The reason for this pulling effect is the occurrence of a redoubtable overturning torque that may cause a tilt of the movable blade. The schematical force diagram shown in FIG. 1B visually illustrates the reason for this overturning torque that occurs in most or all known state of the art hair clipping devices.

F1 therein indicates the driving force that is transmitted at the engagement point 103 from the electric motor driven eccentric to the driving bridge 101. F23 indicates the spring force that is usually provided by one or two springs that resiliently bias the movable blade 102 against the stationary blade. When h1 indicates the distance from the electric motor driven eccentric engagement point 103 to the top surface of the movable cutting 102 and e2 indicates the distance between the spring engagement points, then at the moment of lifting (pulling effect) the following relation results:

$$F23 = F1 \cdot \frac{h1}{e2}$$

Under heavy load conditions, e.g. maximum quantity, tightness, length, thickness and/or shape of the hairs, pulling may thus happen during the cutting process in known hair clipping devices. For every home user, professional hair and beard trimmer and also for the hair cutting of pets, the pulling effect is redoubtable as it may generate remarkable hurt by pulling hairs into the device instead of cutting them. Expertise for the above-mentioned pulling effect is known from the applicant's research as well as from other professionals in hair clipping.

In order to overcome this unwanted pulling-effect, two different approaches are generally known. A lot of prior art hair clipping devices try to overcome this effect by applying an enlarged, strong electric motor. However, such an enlarged electric motor is on one hand expensive and on the other hand also voluminous. It thus increases the overall size of the hair clipping device as well as it increases the production costs. Apart from that, the power consumption of such enlarged electric motors is also higher than for hair clipping devices using smaller electric motors. This is especially disadvantages for battery-driven hair clipping devices which in turn have shorter operating times.

The second common approach to overcome the unwanted pulling effect is the usage of a very strong spring, which presses the two cutting blades (movable cutting blade and stationary cutting blade) against each other with a higher force in order to impede a lifting or tilting of the movable blade.

An example of such a cutting unit for hair clipping device is known from DE 103 02 998 A1. Therein, two strong spring elements arranged in a parallel guiding are applied to press the movable blade against the stationary blade. However, such a high pressure between the movable blade and the stationary blade significantly increases the friction between the two blades. This increased friction makes oiling necessary. Besides that, it increases the abrasion of the two blades as well as of the electric motor. This means that also in this solution, large and robust electric motors, which are comparatively expensive and voluminous, need to be applied.

SUMMARY OF THE INVENTION

Therefore, it is an object of the present invention to provide a hair clipping device which overcomes the above-mentioned disadvantages of the state of the art hair clipping device. In particular, it is an object to provide a hair clipping device and a corresponding cutting assembly for use in such a hair clipping device that overcome the problematic pulling effect and at the same time preferably allow the usage of smaller motors for driving the movable cutting blade. Apart from that, the abrasion shall be reduced for the newly proposed hair clipping device. Thereby, cutting performance shall be improved especially under heavy load conditions.

The above-mentioned problem is solved by a hair clipping device of the kind mentioned initially, which hair clipping device comprises:

a housing;

a cutting assembly which is arranged on one end of said housing and comprises a stationary blade and a moveable blade that is resiliently biased against the stationary blade, wherein the stationary blade and the moveable blade define a cutting plane between each other, wherein the stationary blade comprises a first recess and the moveable blade comprises a second recess, wherein the first and the second recess are arranged on top of each other;

a motor for driving an eccentric transmission element; and a coupling element coupled to said eccentric transmission element for translating a movement of said eccentric transmission element into an oscillatory movement of the moveable blade relative to the stationary blade;

wherein said eccentric transmission element engages the coupling element at at least one engagement point, wherein said at least one engagement point is in at least one operating position during the movement of said eccentric transmission element within said cutting plane, and wherein the coupling element is arranged in said first and second recess.

According to a further aspect of the present invention, the above-mentioned problem is solved by a cutting assembly for use in said hair clipping device, which cutting assembly comprises:

a stationary blade;

a moveable blade that is resiliently biased against the stationary blade, wherein the stationary blade and the moveable blade define a cutting plane between each other, wherein the stationary blade comprises a first recess, and wherein the moveable blade comprises a second recess; and a coupling element that is arranged in said first and second recesses and adapted to be coupled to a rotatory driven eccentric transmission element and adapted to translate a movement of said eccentric transmission element into an oscillatory movement of the moveable blade relative to the stationary blade, wherein said coupling element further comprises an engagement part having at least one engagement point at which said eccentric transmission element can engage the coupling element;

wherein said at least one engagement point is within said cutting plane.

Preferred embodiments of the invention are defined in the dependent claims. It shall be understood that the claimed cutting assembly has similar and/or identical preferred embodiments as the claimed device and as defined in the dependent claims.

The main difference of the proposed hair clipping device to state of the art hair clipping devices is that the engagement of the eccentric transmission element to the coupling element is within cutting plane, which is also referred to as the cutting level. The cutting plane or cutting level denotes the imaginary plane between the stationary blade and the movable blade, i.e. the contacting plane along which the movable blade and the stationary blade contact each other. In other words, the movable blade and the stationary blade contact each other along said cutting plane (cutting level). In contrast to common cutting units, where an overturning torque may occur that could lead to the unwanted pulling effect, because the engagement of the eccentric transmission element is always far out of the cutting level, the configuration according to the present invention applies a newly designed coupling element (commonly also referred to as driving bridge) that allows an engagement of the eccentric transmission element to the coupling element within the cutting level.

The coupling element/driving bridge is a part that translates the rotary movement of the eccentric transmission element (usually realized by an eccentric pin that is arranged on a rotary driven shaft of the motor) into a translatory oscillation of the movable blade with respect to the stationary blade. As the engagement of the eccentric pin to the driving bridge is now designed to be within the cutting level, the driving force is in contrast to known clipping devices transmitted directly within the cutting level/cutting plane. An overturning torque or tilting moment, as this occurs within known clipping devices is thus reduced to a minimum or even to zero. The undesirable pulling effect may thus no longer occur, even when only applying regular springs to resiliently bias the movable blade against the stationary blade and/or even when applying regular electric motors for driving said movable blade.

If the at least one engagement point lies within said cutting plane, an overturning torque can per se not start and the pulling effect is completely avoided. The force for driving the movable blade is thus transmitted only in the cutting level. Hence, there is no lever between the engagement point (contact point between the eccentric transmission element and the coupling element/driving bridge) so that from a mechanical point of view a tilting moment, herein referred to as overturning torque, cannot arise. As the pulling effect is therewith avoided, the hair cutting performance is significantly improved.

It is to be noted that the eccentric transmission element may in some operating positions due to its rotary movement have a small distance to the cutting plane. Due to the rotary movement of the eccentric transmission element, the at least one engagement point between the eccentric transmission element and the coupling element (driving bridge) may slightly move away and towards the cutting plane along a trajectory that more or less resembles a parallelogram. However, due to the spring force with which the movable blade is pressed against the stationary blade, this trajectory does not exactly resemble a parallelogram. In the herein proposed arrangement the coupling element (driving bridge) is preferably fixed within the cutting assembly so that the above-described relative height movement is suppressed, i.e. so that the driving bridge almost perfectly follows a translatory movement and that the at least one engagement point between the eccentric transmission element and the coupling element does not even vary at all in height. In the most effective embodiment the at least one engagement point lies during the whole movement of the eccentric transmission element within the cutting plane.

The arrangement of the at least one engagement point lying within the cutting level is mainly realized through a newly designed coupling element (driving bridge), which is in contrast to state of the art hair clipping device no longer mounted on the upper surface of the movable blade, but displaced further down towards the cutting level. The therewith created overturning torque-free engagement of the cutting forces on the cutting unit, i.e. on the movable blade, allows for a significantly improved cutting performance, especially when it comes to heavy load caused by maximum quantity, tightness, length, thickness and form of the hairs.

By having the eccentric engagement directly within the cutting level, the hair cutting performance is significantly improved, as no overturning torque appears, which could lift or tilt the movable blade. Thus, the pulling effect is effectively avoided. The significantly reduced or even completely avoided overturning torque on the other hand guarantees that the power transmission from the motor to the movable blade is transmitted with the lowest possible friction. Thus, the abrasion between the movable blade and the stationary blade may be reduced to a minimum, leading to significantly longer operating times without having to replace wear and tear parts of the clipping device. The omission of the pulling effect also increases the user comfort, since painful pulling of the hairs does not occur any more.

In order to establish the above-mentioned spatially low position of the at least one engagement point, where the eccentric transmission element engages the coupling element, the coupling element (driving bridge) is preferably arranged in said first and second recess. Compared to state of the art hair clipping devices, the driving bridge itself is thus not anymore arranged above the movable cutting blade but directly within the cutting level. A recess is thereto cut into the movable blade as well as into the stationary blade, so that the coupling element may be placed therein and is arranged on the same height level as the movable blade and the stationary blade. Thus, the above-mentioned force engagement can be directly in the cutting level of the toothed edges of the two blades.

Preferably said first and second recess are realized as rectangular recesses in the two blades. The two recesses are preferably formed as congruent recesses that open out into each other in order to form a rectangular hole through the movable blade and the stationary blade, in which the coupling element may be arranged.

According to a further embodiment of the present invention, a lower part of said eccentric transmission element is in at least one operating position during the movement of said eccentric transmission element tangent to said cutting plane or spatially crosses said cutting plane. Preferably, the lower part of said eccentric transmission element is during the whole movement (not only in at least one operating position) of said eccentric transmission element tangent to said cutting plane.

In other words, the eccentric transmission element protrudes to or into the cutting plane (cutting level). The term "spatially crossing" shall denote that parts of the eccentric transmission element could, during its movement, be arranged or lie under the cutting level. Even though the eccentric transmission element crosses the cutting plane (cutting level) during its movement, the at least one engagement point still is or lies within the cutting plane during the whole movement.

Compared to known hair clipping devices, where the eccentric transmission element usually ends and engages the driving bridge on a level that is above the movable cutting blade, the eccentric transmission element is in the herein proposed arrangement arranged on a lower level. As already mentioned above, an overturning torque leading to a tilt or lift of the movable cutting blade is thereby almost completely or even completely impeded.

According to a further embodiment of the present invention, the eccentric transmission element is clamped into the coupling element between at least two engagement points, wherein said at least two engagement points are in at least one operating position during the movement of said eccentric transmission element within said cutting plane.

The eccentric transmission element is thereto preferably realized as an eccentric pin that protrudes into a V-shaped groove within the coupling element (driving bridge). This eccentric pin preferably contacts the V-shaped groove of the driving bridge at two contacting points (referred to as engagement points). Since the opening end of the V-shaped groove is chosen to be within the cutting level, said two contacting points preferably lie within the cutting level (cutting plane) during the whole movement/rotation of the eccentric pin. A two-point clamping as mentioned above allows a mechanically stable connection between the eccentric transmission element and the coupling element, wherein the eccentric transmission element may still rotate relative to the coupling element.

In an embodiment, the coupling element is fitted into the first and second recess to form a positive locking between said coupling element and said first and second recess. This has the additional positive effect that the hole formed by the first and the second recess may act as a sliding guide for the driving bridge, which limits the movement of the movable blade relative to the stationary blade in the direction perpendicular to the cutting edges of the two blades. This gives a limit to the so-called tip-to-tip distance, which denotes the distance between the frontal cutting edge of the movable blade and the frontal cutting edge of the stationary blade. Since this tip-to-tip distance is defined and limited by the driving bridge arranged within the first and the second recess, the tip-to-tip distance may never be too small and on the other hand not too big. A too small tip-to-tip distance could increase the risk of hurting the user with the movable cutting blade. A too big tip-to-tip distance, on the other hand, could make the hair cutting ineffective, since the hairs to be cut may probably not reach the movable blade. However, both problems are overcome due to the arrangement of the coupling element (driving bridge) within the cutting level, which at the same time limits the movement of the two cutting blades relative to each other in a direction perpendicular to the cutting edges of the cutting blades.

As the two recesses are preferably shaped rectangularly and the coupling element is fitted therein by a positive locking from all four sides, the coupling element is holded within the movable and the stationary cutting blade like in a steel frame. As the coupling element (driving bridge) is usually realized by a plastic part, the creep behaviour of the plastic material is in this way limited. Therefore, the tolerance of the driving bridge chamber is more constant than in conventional cutting units, in which the driving bridge is usually mounted on top of the movable blade. Due to the limitation that the cutting element provides hindering the movable blade to move perpendicular to its toothed cutting edge, the tip-to-tip distance is constant over the whole movement stroke of the movable blade. The above-mentioned arrangement furthermore reduces the friction between the driving bridge and the eccentric transmission element, which again reduces the power consumption and furthermore minimizes the noise level. Preferably, the first recess and the second recess protrude substantially parallel to a cutting edge of said movable blade.

According to a further embodiment of the present invention, the hair clipping device comprises at least one first ball bearing which is arranged between the movable blade and the stationary blade. This at least one first ball bearing guides the movable blade on the stationary blade by at least one rolling ball.

In contrast to known hair clipping devices of the prior art, in which the movable blade usually glides on the movable blade, friction is thereby significantly reduced. As it is known, there is a huge difference between gliding and rolling friction. Gliding friction is usually calculated by $F_R=\mu \cdot F_N$, wherein the gliding friction coefficient $\mu$ for steel against steel is between 0.3 and 1.5; whereas rolling friction: $F_R=c_R \cdot F_N$, has a rolling friction coefficient $c_R$ for steel against steel between 0.001 and 0.0005.

The friction force in a rolling friction condition is thus only 3% from the comparable gliding friction force. The appliance of a ball bearing between the movable blade and the stationary blade thus significantly benefits the frictional behaviour between the two blades. By guiding the movable blade relative to the stationary blade with, for example, two ball bearings, the tip-to-tip distance is also remained constant during the movement of the movable blade. Due to the reduced friction (rolling friction) the power consumption of the electric motor is also reduced. Furthermore, this also decreases the risk of the above-mentioned unwanted pulling effect. It gives the consumer the reliability that the user gets not hurt through a pulled cutting element while cutting his/her hair. This increases the safety and confidence of the user to the hair cutting device. Besides that, the reduced rolling friction may lead to higher cutting speeds compared to common hair clipping devices using the same type of electric motors as the force transmission from the electric motor to movable blade is significantly improved.

According to a further embodiment, said at least one first ball bearing is arranged between two semicircular guiding recesses formed in the movable blade and the stationary blade. These two semicircular guiding recesses are preferably arranged across each other and the ball of the ball bearing is arranged in between. Both semicircular recesses appear as a kind of grinded half-pipe within the movable blade and the stationary blade, respectively.

Common cutting units are designed with a guiding of the movement by levers of a spring that presses the movable blade against the stationary blade. These levers of the spring increase the clamping force between the movable and the stationary blade. Some cutting elements are guided by a guiding with a plastic engagement of the driving bridge into a rectangular slot of the stationary blade. In these cases, the guiding part needs more space for movement, because gliding friction exists.

The herein proposed ball bearings with a ball guided in a grinded half-pipe instead give the lowest possible rolling friction. Cutting tests with the hair clipping device according to the present invention have shown remarkably good performance under extreme tight hairs, an extreme quantity of hairs or under other difficult operating conditions. The device according to the present invention has shown perfect hair cut results without the occurrence of the redoubtable pulling effect.

Preferably, said at least one first ball bearing is coupled to the coupling element (driving bridge). This may, for example, be realized by a small connection element that connects the driving bridge with the at least one first ball bearing. The driving bridge connection is only foreseen to give the ball bearings an orientation and to hinder the balls of the ball bearings to slip out of the semicircular recesses, in which they are guided. Different variations of the placement of said at least one ball bearing between the movable and the stationary blade are possible and generally conceivable. In the simplest configuration, two ball bearings may be arranged between the movable and the stationary blade on the teeth averted rear side of the blades. In this case, the two balls of the two ball bearings may be arranged between said two grinded half-pipes, wherein the two balls itself may be arranged in two respective holes within the above-mentioned connection element that connects the two ball bearings with the coupling element (driving bridge). However, also other arrangements are conceivable, in which more than two ball bearings are applied.

According to a further embodiment, the hair clipping device may comprise at least one second ball bearing which is arranged between the movable blade and the stationary blade, wherein the above-mentioned at least one first ball bearing and the at least one second ball bearing are arranged on different sides of said first and second recesses of the movable blade and the stationary blade. In other words, the at least two ball bearings are arranged on different sides of the driving bridge. A variation with three ball bearings is especially preferred since this leads to a statically determined condition. For example, two ball bearings may be arranged between the driving bridge and the toothed cutting edge of the movable blade and the third ball bearing may be arranged on the other side of the driving bridge, i.e. on the teeth averted rear side of the cutting unit. However, the arrangement of the three ball bearings may also be the other way-around, i.e. one ball bearing between the driving bridge and the toothed cutting edge of the movable blade and two ball bearings on the teeth averted rear side of the cutting unit.

In all above-mentioned placement variations of the ball bearings, it is preferred that the centre of the at least one first ball bearing and/or the centre of the at least one second ball bearing is arranged within the cutting plane (cutting level). Similar as already mentioned above, this has the technical effect that no tilting moments or overturning torques act on the ball bearings as they are arranged within the cutting level in which the driving force is transmitted.

BRIEF DESCRIPTION OF THE DRAWINGS

These and other aspects of the invention will be apparent from and elucidated with reference to the embodiment(s) described hereinafter. In the following drawings FIG. 1 shows a schematical drawing illustrating the arrangement of a driving bridge on a movable blade according to the prior art;

DETAILED DESCRIPTION OF THE INVENTION

Figure 2:
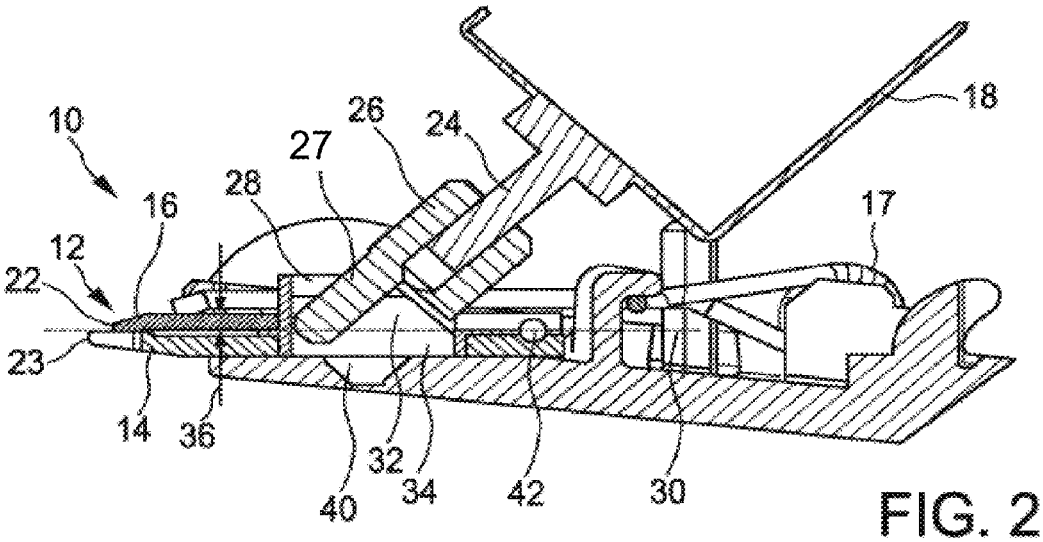
FIG. 2 shows a sectional view of an embodiment of the hair clipping device according to the present invention.
Figure 3:
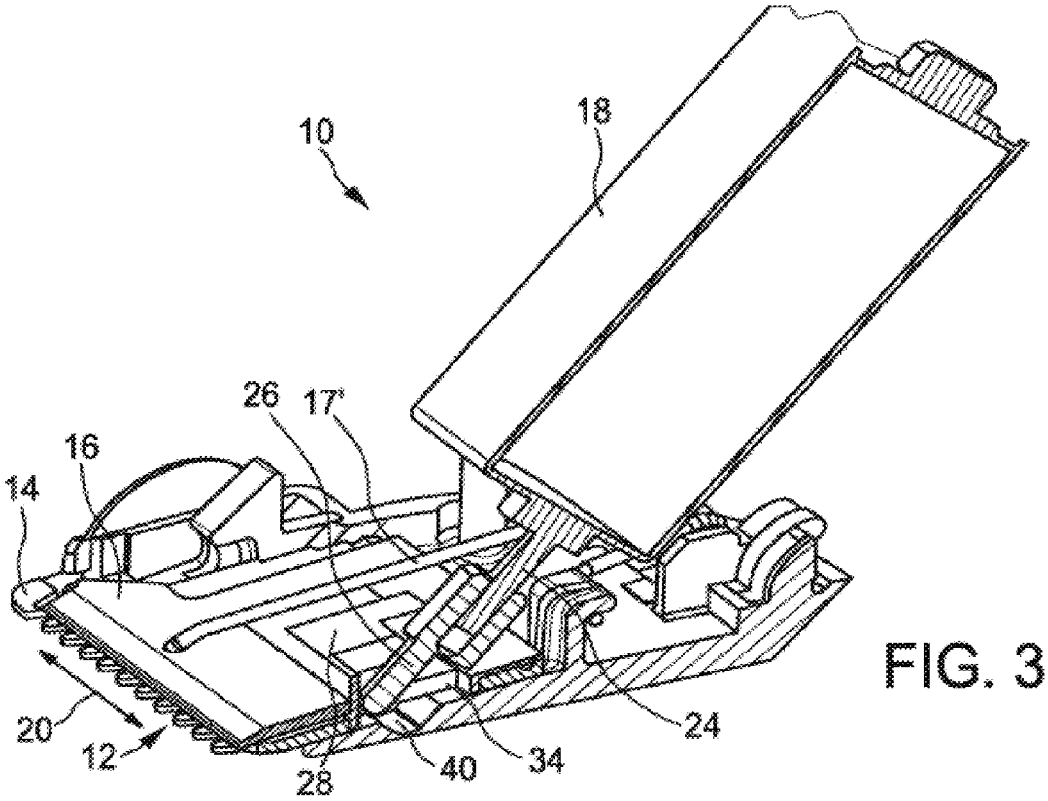
FIG. 3 shows a perspective sectional view of the embodiment shown in FIG. 2 of the hair clipping device according to the present invention.
Figure 4:
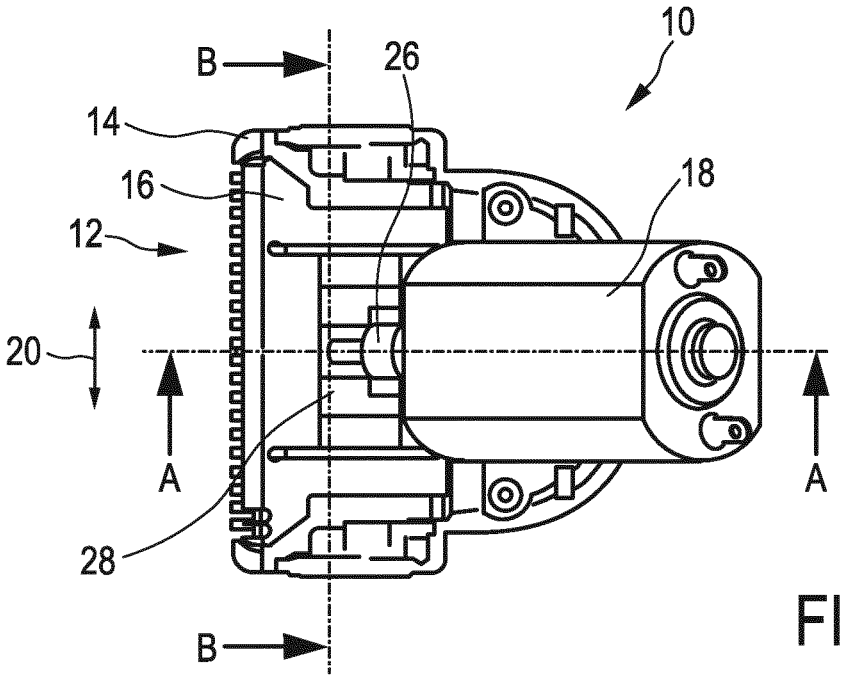
FIG. 4 shows a top view of the embodiment shown in FIG. 2 of the hair clipping device according to the present invention.
Figure 5:
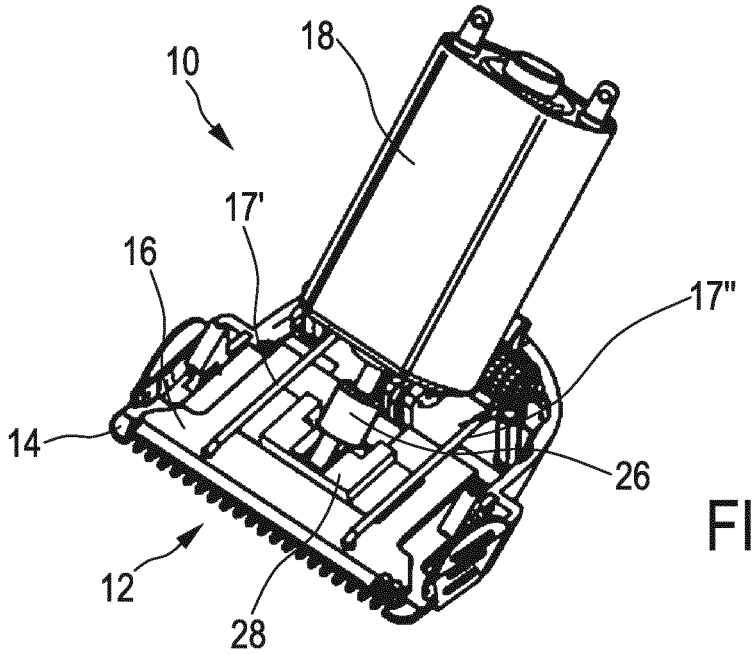
FIG. 5 shows a perspective view of the embodiment shown in FIG. 2 of the hair clipping device according to the present invention.
Figure 6:
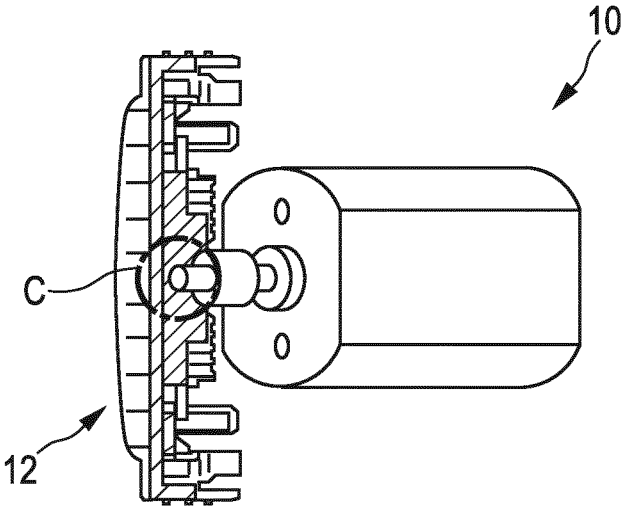
FIG. 6 shows a frontal view of the embodiment shown in FIG. 2 of the hair clipping device according to the present invention.

FIGS. 2 to 6 schematically illustrate the principle design of a hair clipping device according to the present invention which is therein in its entirety denoted with reference numeral 10. FIGS. 2 and 3 show sectional views of the hair clipping device 10 and FIGS. 4 to 6 show the hair clipping device 10 from different sides. FIG. 2 therein refers to the sectional view A-A (see FIG. 4) and FIG. 6 refers to the sectional view B-B (see FIG. 4).

The hair clipping device 10 according to the present invention usually comprises a housing (not explicitly shown) in which all remaining parts are usually integrated and which serves as a holder for a cutting assembly 12. The housing usually has an elongated body, wherein the cutting assembly 12 is releasably fixed to a front end of said housing. The housing usually further comprises a handle at its rear end (not shown). The outer surface of the elongated housing may, for example, be tapered outwardly from the rear end to the front end and may have a slightly bent development to provide a more ergonomic holding position and to improve the esthetic appearance of the clipping device 10. However, it is to be noted that also other housing arrangements and designs are envisaged without leaving the scope of the invention.

The cutting blade assembly 12 includes a stationary blade 14 and a movable blade 16. The movable blade 16 is displaceably mounted on an upper surface of the stationary blade 16, which upper surface faces substantially towards the inner side of the housing. By the help of a spring 17 that comprises two spring levers 17', 17" the movable blade 16 is pressed onto the stationary blade 14 in order to keep the two blades close together. The movable blade 16 may comprise a toothed edge 22 with an array of teeth that is arranged substantially parallel to a front edge 23 of the stationary blade 14. Instead of a toothed edge 22 the front edge of the movable blade may also be designed as a sharp continuous edge as this is illustrated in FIGS. 2 to 5. During operation hair cutting is performed due to the interaction of the stationary blade 14 and the movable blade 16 that reciprocates on the stationary blade 14 as this is known from other conventional hair clipping devices.

The stationary blade 14 is usually designed to be thicker than the movable blade 16. Said stationary blade 14 is also denoted as "guard". Similar as the front edge 22 of the movable blade 16, the front edge 23 of the guard 14 may either be designed as a sharp continuous edge or as a toothed edge with an array of cutting teeth. In order to receive a good cutting performance, the movable blade 16 is actively pressed to the upper surface of the guard 14 to receive a so-called teeth pressure. This teeth pressure is, inter alia, guaranteed by the above-mentioned spring 17 that presses the two blades 14, 16 together.

A drive arrangement including a motor 18 is adapted to drive the movable blade 16 in an oscillatory movement in a transverse direction 20 parallel to a front cutting edge 22 of the movable blade 16. The motor 18 thereto comprises a rotatory driven shaft 24 that is forced into rotation. An eccentric transmission element 26 including an eccentric pin 27 protruding therefrom is arranged on said rotatory driven shaft 24. The eccentric transmission element 26 may be clamped onto the rotatory driven shaft 24 or coupled to it in any other way. However, the rotatory driven shaft 24 and the eccentric transmission element 26 may also be realized as one integrated part. The motor 18 itself may, for example, be realized as an electric motor that is either powered by main supplied electricity or battery-driven.

The rotatory movement of the eccentric translation element 26 is translated into the translatory movement of the movable blade 16 via a coupling element 28. The coupling element 28 is usually also called driving bridge 28. The coupling element or driving bridge 28 is usually realized as a plastic part. However, also other materials may be generally used for the coupling element 28.

One of the central points of the present invention relates to the arrangement of the coupling element 28 as well as to the arrangement of the eccentric transmission element 26 relative thereto. In contrast to state of the art hair clipping devices, where said driving bridge 28 is mounted on the top surface of the movable blade 16 (compare driving bridge 101 shown in FIG. 1*a*), the driving bridge 28 is according to the present invention integrated into the cutting assembly 12. Compared to the state of the art, the driving bridge 28 is therefore arranged at a spatially lower position with respect to the cutting assembly 12. Also different as in prior art devices and even more important is the spatial arrangement of the eccentric transmission element 26. Said eccentric transmission element 26 is also arranged at a spatially lower position as in prior art hair clipping devices.

According to the present invention, said eccentric transmission element 26 engages the coupling element 28 at a position that lies in the cutting level 30. The cutting level 30, which is also referred to as cutting plane 30, defines the imaginary plane between the stationary blade 14 and the movable blade 16 along which both blades 14, 16 contact each other.

In order to guarantee such a low arrangement of the coupling element 28 and the engagement of the eccentric transmission element 26 with the coupling element 28, the coupling element/driving bridge 28 is arranged in a first recess 32 and a second recess 34 that form a common recess in the movable blade 16 and the stationary blade 14. The first recess 32 is a recess within the movable blade 16 that preferably has a rectangular shape. The second recess 34 is a congruent recess in the stationary blade 14, which may have the same shape and size as the first recess 32. Together, these two recesses 32, 34 build an inclusion within the cutting assembly 12 for receiving said coupling element/driving bridge 28. Therefore, the coupling element 28 is no longer arranged above the cutting plane/cutting level 30 (as in the prior art) but arranged within the cutting level 30.

The eccentric transmission element 26 engages the coupling element 28 at at least one engagement point. This at least one engagement point is chosen such that it lies in at least one operating position during the movement of the eccentric transmission element 26 in the cutting plane 30. Preferably, said at least one engagement point is during the whole movement of said eccentric transmission element 26 (not only in at least one operating position) within the cutting plan 30.

Such an arrangement reduces the mechanical lever (distance between engagement point and cutting level 30) to zero or almost zero and thus reduces the risk of occurring overturning torques that may lead to a tilt of the movable blade 16. Such a tilt of the movable blade 16 is also known as pulling effect which significantly decreases the hair cutting performance and may lead to a pulling-in of hair into the cutting assembly 12 instead of cutting the hairs with the blades 14, 16. This is, of course, unpleasant for the user as a pulling-in of hair may hurt a lot.

Arranging the engagement of the eccentric transmission element 26 with the coupling element/driving bridge 28 within the cutting plane 30 leads to the fact that the transmission forces for driving the movable blade 16 are transmitted within the cutting level 30 in an overturning torque-free manner.

Figure 7:
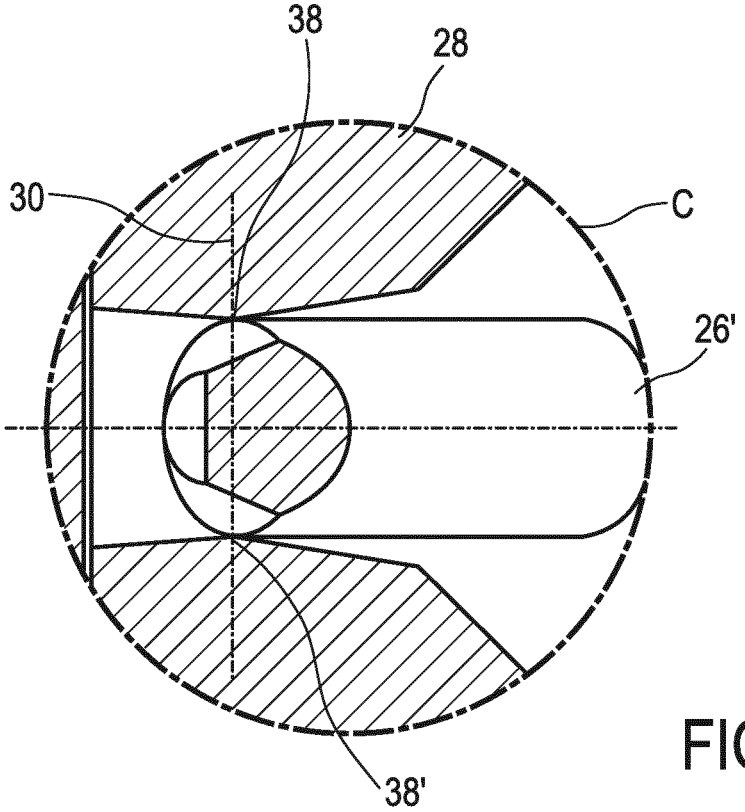
FIG. 7 shows an enlarged view of a part of the hair clipping device according to the present invention illustrated in FIG. 6.

FIG. 7 shows the engagement of the eccentric transmission element 26 with the coupling element 28 in an enlarged view. The engagement is shown therein in a most preferred position. According to the present invention it is most preferred that the eccentric transmission element engages the coupling element 28 with its eccentric pin 27 at at least one engagement point 38, 38', wherein said at least one engagement point 38, 38' is in at least one operating position during the movement of the eccentric transmission element 26 arranged within the cutting plane 30. Preferably, said at least one engagement point 38, 38' is in during the whole movement of the eccentric transmission element 26 arranged within the cutting plane 30. In that way force will be only transmitted within the cutting level 30. As it can be further seen from FIG. 7, the eccentric pin 27 is preferably clamped into a V-shaped recess within the coupling element 28. It contacts the coupling element 28 at two engagement points 38, 38'. The intersection connecting the two engagement points 38, 38' may also be denoted as "engagement line". Due to the above-mentioned arrangement, which is also shown in the accompanying drawings, said engaging line, in other words falls together with the cutting plane 30 during the whole movement of the eccentric transmission element 26. Preferably, they do not only fall together in at least one operating position, but during the whole movement of said eccentric transmission element 26. The reason why this is mentioned herein is that the coupling element 28 could be slightly lifted during the rotation of the eccentric pin 27. However, due to the V-shaped recess in the coupling element 28 this relatively small lifting movement of the coupling element/driving bridge 28 may be balanced or even suppressed, so that the engagement points 38, 38' are during the complete movement of the eccentric transmission element 26 arranged within the cutting plane 30.

As it can be seen from FIGS. 2 and 3 the guard 14 furthermore comprises an additional recess 40 that is mainly foreseen to provide enough space for the movement of the eccentric pin 27 in order to prevent collisions.

In summary, the engagement of the eccentric transmission element 26 with the driving bridge 28 is herein designed to be at a spatially lower position compared to known cutting units, in which always an overturning torque is possible that leads to the redoubtable pulling effect. However, due to the herein proposed arrangement this pulling effect may not occur in the clipping device 10 according to the present invention.

A further advantage of the hair clipping device 10 according to the present invention becomes apparent from the arrangement of the coupling element/driving bridge 28 within the recesses 32, 34. The recesses 32, 34 act as a sliding guide for the driving bridge 28. Since the driving bridge 28 is fitted into the recesses 32, 34 by a positive locking, a movement of the movable blade 16 relative to the stationary blade 14 (guard) perpendicular to the transverse direction 20 is limited. The driving bridge 28 accordingly limits the movement of the movable blade 16 and keeps the so-called tip-to-tip distance, i.e. the distance between the front edge 22 of the movable blade to the front edge 23 of the stationary blade, constant during the movement of the movable blade 16. This is especially advantageous, since the tip-to-tip distance becomes never too small so that a user may be hurt by the movable cutting blade 16, and on the other hand never becomes too big, which then could impede the cutting performance (no function because no piece in functional cutting condition). A further positive effect is that the driving bridge 28 is held in the recesses 32, 34 like in a steel frame. In this way, the creep behaviour of the plastic material from which the driving bridge 28 is manufactured, is limited. Therefore, the tolerance of the driving bridge 28 is more constant than in conventional cutting units, which do not have a driving bridge bordered in a metal frame.

All over all, this reduces friction between the driving bridge 28 and the eccentric pin 26' and reduces power consumption as well as it minimizes the noise level of the clipping device 10.

A further central point of the present invention relates to the guidance of the movable blade 16 on the stationary blade 14. Compared to state of the art clipping devices, in which the movable blades usually glide over the stationary blades so that gliding friction is produced therein between, the hair clipping device 10 according to the present invention comprises a ball bearing 42 between the movable blade 16 and the stationary blade 14 in order to establish a rolling friction between these two blades 14, 16.

As friction forces accompanied with rolling friction are only 3% from the corresponding friction forces accompanied with gliding friction, the friction between the movable and the stationary blade 14, 16 is significantly reduced according to the present invention. Besides abrasion, this also significantly reduces the noise level of the clipping device 10. Apart from that, less driving force is lost due to friction so that smaller electric motors may be applied or higher cutting speeds may be reached with the same electric motors.

Figure 8:
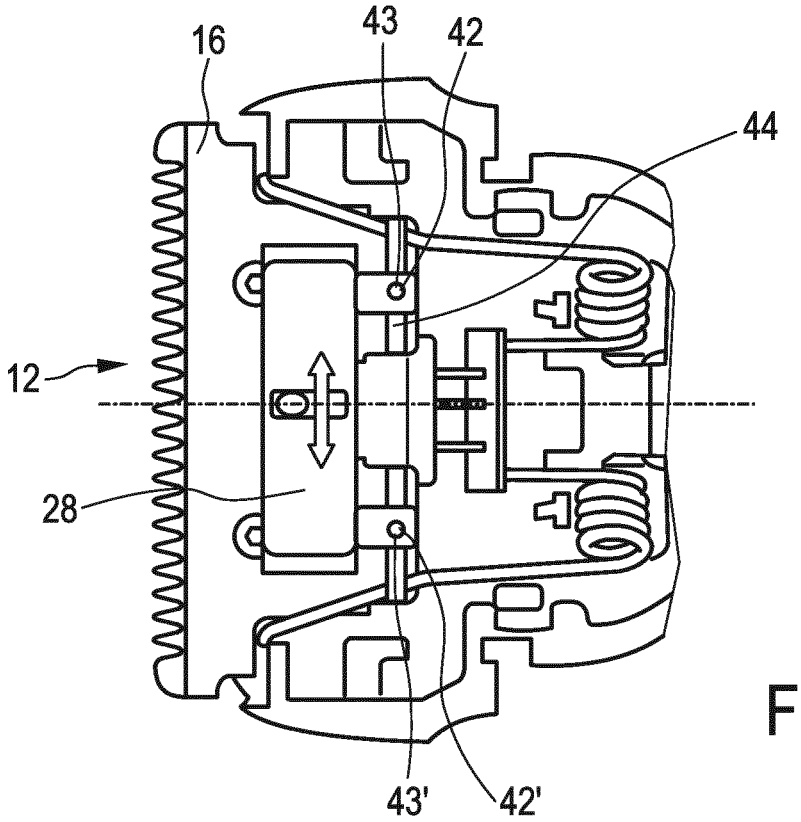
FIG. 8 shows a detail of a second embodiment of the hair clipping device according to the present invention.
Figure 9:
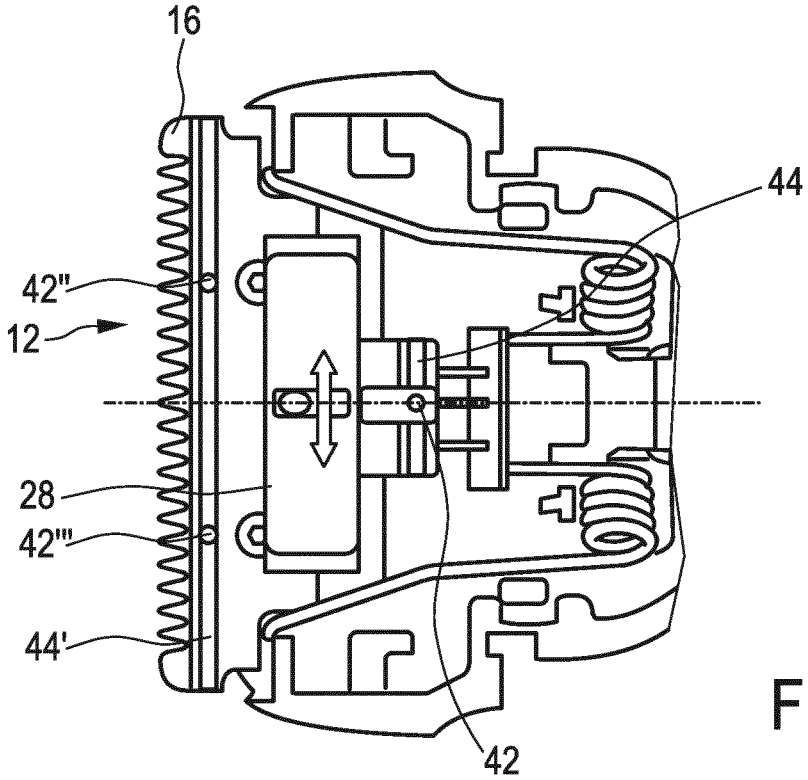
FIG. 9 shows a detail of a third embodiment of the hair clipping device according to the present invention.

FIGS. 8 and 9 schematically show the arrangement of the at least one ball bearing 42. In one embodiment illustrated in FIG. 8, two ball bearings 42, 42' are provided on the teeth averted rear side of the cutting unit 12. The balls 43, 43' of the ball bearings 42, 42' are guided in a semicircular guiding recess 44 formed into the movable blade and a corresponding semicircular guiding recess formed parallel thereto into the stationary blade (not explicitly shown). The guiding recess 44 in other words has a shape of a half-pipe. As it can be furthermore seen from FIG. 8, the two ball bearings 42, 42' are coupled to the coupling element 28 in order to guide the ball bearings 42, 42' during the reciprocal movement of the movable cutting blade 16. The semicircular recess 44 is preferably arranged substantially parallel to the front edge 22 of the movable blade 16.

In a different embodiment illustrated in FIG. 9, three ball bearings 42, 42", 42'" are provided. One ball bearing 42 arranged on the teeth averted rear side of the cutting unit 12 and the other two ball bearings 42", 42'" arranged on the other side of the coupling element 28 and guided in a further semicircular recess 44'. This arrangement realizes a statically determinate design, which leads to a maximum stability during the reciprocal movement of the movable cutting blade 16.

It is to be noted that also other variations and arrangements of the ball bearings 42 are possible. The position as well as the number of ball bearings may be varied and adapted to the specific needs.

Figure 10:
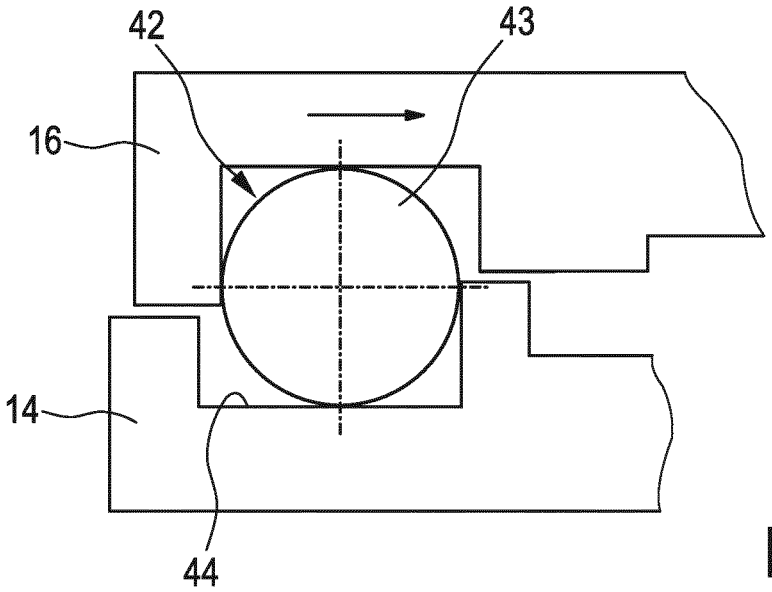
FIG. 10 shows an enlarged view of a further embodiment of a ball bearing that may be used in the hair clipping device according to the present invention, wherein the ball bearing is in a first position.
Figure 11:
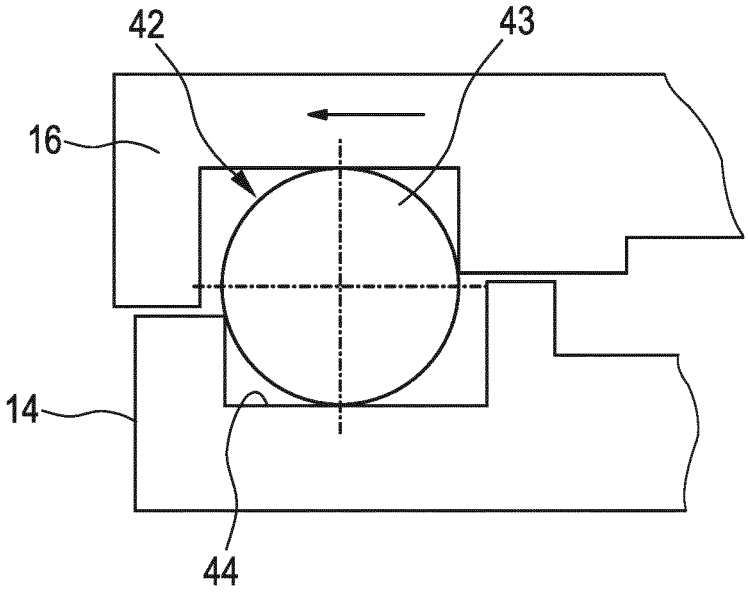
FIG. 11 shows an enlarged view of the ball bearing shown in FIG. 10, wherein the ball bearing is in a second position.

Instead of semicircular guiding recesses 44 for the ball bearings 42, 42', the recesses 44 may also have a rectangular shape as illustrated in FIGS. 10 and 11. Rectangular recesses 44, compared to semicircular recesses 44, provide an increased resistance against the lifting effect. By comparing FIG. 10 with FIG. 11 it can be seen that the ball 43 of the ball bearing 42 may not slip out of the rectangular recesses 44 in case the moveable blade 16 is slightly displaced relative to the stationary blade 14. Whereas this might lead the ball 43 to slip out of a semicircular guiding recess, this may be prevented with a rectangular recess 44. Therefore, the unwanted lifting effect may not occur at any time.

Figure 12:
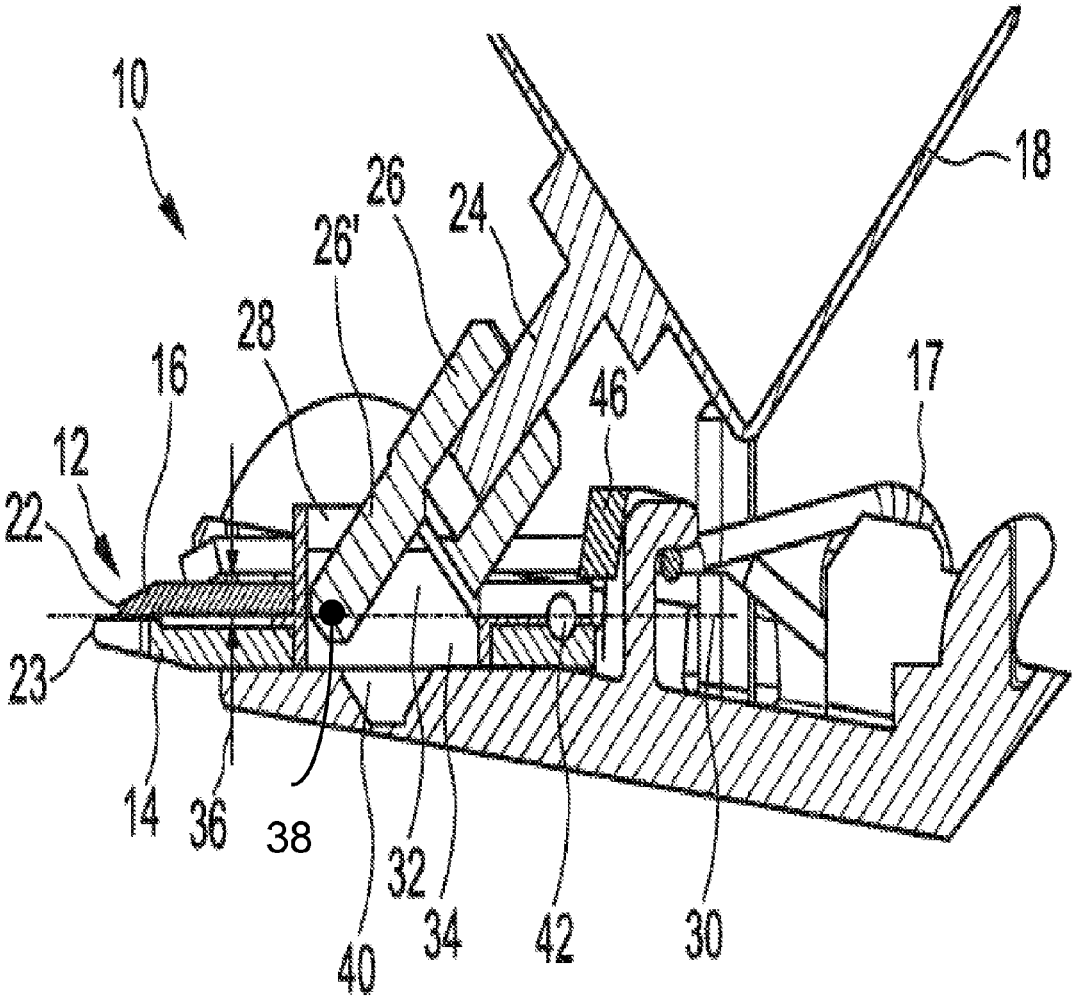
FIG. 12 shows a sectional view of a further embodiment of the hair clipping device according to the present invention.
Figure 13:
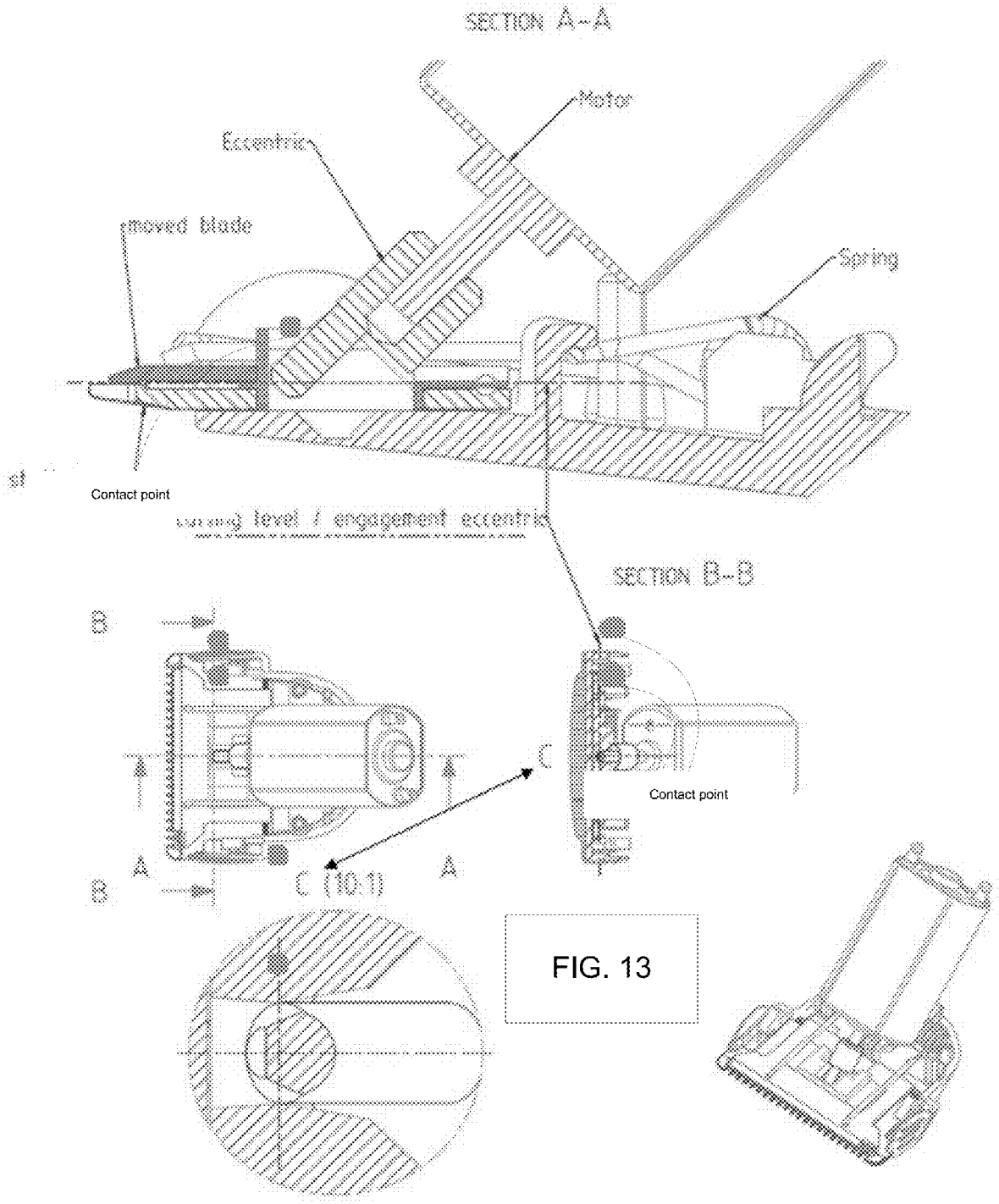

An additional element for preventing the lifting effect is shown in FIG. 12. FIG. 12 shows a hook element 46 that is arranged above the moveable cutting blade 16. This hook element 46 is adapted to press the moveable cutting blade 16 with contact pressure against the stationary cutting blade (in addition to the spring element 17). A lifting of the moveable cutting blade 16 is thereby prevented.

In summary, the present invention provides a hair clipping device which effectively overcomes the problem of an unwanted pulling of the movable cutting blade. Due to the special technical design that is chosen in the presented hair clipping device, the hair clipping device is especially in terms of cutting performance, force transmission effectiveness, friction, wear and tear as well as in terms of noise level significantly improved.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. Hair clipping device, comprising:

a housing;

a cutting assembly which is arranged on one end of said housing and comprises a stationary blade and a moveable blade that is resiliently biased against the stationary blade by a spring comprising two spring levers, wherein the stationary blade and the moveable blade define a cutting plane between each other, an eccentric transmission element including an eccentric pin protruding therefrom and arranged on a rotary driven shaft, a motor comprising said rotary driven shaft for driving said eccentric transmission element; and a coupling element coupled to said eccentric transmission element for translating a movement of said eccentric transmission element into an oscillatory movement of the moveable blade relative to the stationary blade;

wherein the coupling element is arranged inside of a common recess formed from a first rectangular recess in the moveable blade and a second rectangular recess in the stationary blade that form said common recess in the movable blade and the stationary blade;

wherein said eccentric transmission element engages the coupling element at at least one engagement point in the same plane as the cutting plane, wherein said at least one engagement point is in at least one operating position during the movement of said eccentric transmission element within said cutting plane, and wherein the coupling element is arranged in said first and second recess, wherein the coupling element is displaced at a spatially low position of the at least one engagement point, where the eccentric transmission element engages the coupling element, and wherein said engagement of said eccentric transmission element engaging said coupling element is within a contacting plane along which the movable blade and the stationary blade contact each other.

2. Hair clipping device according to claim 1, wherein a lower part of said eccentric transmission element is in at least one operating position during the movement of said eccentric transmission element tangent to said cutting plane or spatially crosses said cutting plane.

3. Hair clipping device according to claim 1, wherein the eccentric transmission element is clamped into the coupling element between at least two engagement points, wherein said at least two engagement points are in at least one operating position during the movement of said eccentric transmission element within said cutting plane.

4. Hair clipping device according to claim 1, wherein the coupling element is fitted into the first and second recess to form a positive locking between said coupling element and said first and second recess.

5. Hair clipping device according to claim 1, wherein the first and second recess protrude substantially parallel to a cutting edge of said moveable blade.

6. Hair clipping device according to claim 1, further comprising at least one first ball bearing which is arranged between the moveable blade and the stationary blade.

7. Hair clipping device according to claim 6, wherein said at least one first ball bearing is arranged between two semicircular guiding recesses formed in the moveable blade and the stationary blade, respectively.

8. Hair clipping device according to claim 6, wherein said at least one first ball bearing is coupled to the coupling element.

9. Hair clipping device according to claim 6, further comprising at least one second ball bearing which is arranged between the moveable blade and the stationary blade, wherein the at least one first ball bearing and the at least one second ball bearing are arranged on different sides of said first and second recess of the moveable blade and the stationary blade.

10. Hair clipping device according to claim 6, wherein the centre of the at least one first ball bearing and/or the centre of the at least one second ball bearing is arranged within the cutting plane.

11. Cutting assembly for use in a hair clipping device 1, comprising:

a stationary blade;

a moveable blade that is resiliently biased against the stationary blade, wherein the stationary blade and the moveable blade define a cutting plane between each other, wherein a common recess is formed from a first rectangular recess in the moveable blade and a second rectangular recess in the stationary blade that collectively form a common recess in the moveable blade and the stationary blade; and a coupling element that is arranged in the common recess coupled to a rotatory driven eccentric transmission element and adapted to translate a movement of said eccentric transmission element into an oscillatory movement of the moveable blade relative to the stationary blade, wherein said coupling element further comprises an engagement part having at least one engagement point at which said eccentric transmission element can engage the coupling element;

wherein said eccentric transmission element engages the coupling element at said at least one engagement point in the same plane as the cutting plane.

* * * * *